United States Patent [19]

Davis et al.

[11] 4,100,762

[45] Jul. 18, 1978

[54] INTEGRATED CONTROLS ASSEMBLY

[75] Inventors: Gerald L. Davis; Timothy C. Scott, both of Bristol, Va.

[73] Assignee: Sundstrand Corporation, Rockford, Ill.

[21] Appl. No.: 737,990

[22] Filed: Nov. 2, 1976

[51] Int. Cl.[2] ..... F25B 13/00; F25B 47/00; F25B 43/00

[52] U.S. Cl. ..... 62/160; 62/278; 62/324; 62/503

[58] Field of Search ..... 62/278, 160, 324, 503; 165/29

[56] References Cited

U.S. PATENT DOCUMENTS

| | | | |
|---|---|---|---|
| 2,342,566 | 2/1944 | Wolfert | 62/324 |
| 2,715,318 | 8/1955 | Millman | 62/324 |
| 2,750,764 | 6/1956 | Lynch | 62/160 |
| 2,900,801 | 8/1959 | Honegger | 62/503 |
| 2,983,286 | 5/1961 | Greenawalt et al. | 62/324 |
| 3,264,837 | 8/1966 | Harnish | 62/160 |
| 3,552,140 | 1/1971 | Palmer | 62/324 |
| 3,609,990 | 10/1971 | Bottum | 62/278 |
| 3,938,349 | 2/1976 | Ueno | 62/503 |
| 3,938,351 | 2/1976 | Schumacher | 62/503 |
| 3,955,375 | 5/1976 | Schumacher | 62/503 |

*Primary Examiner*—Lloyd L. King
*Attorney, Agent, or Firm*—Wegner, Stellman, McCord, Wiles & Wood

[57] ABSTRACT

An integrated controls assembly for controlling fluid flow between first and second heat exchangers and a compressor in a heat pump, air conditioner, or like system. The integrated controls assembly includes an accumulator in the form of a tank communicating by conduits with the discharge outlet and the suction inlet of the compressor. The conduit leading from the discharge outlet includes a coiled section contained within the accumulator and leading to a reversing valve assembly, also contained within the accumulator. The reversing valve selectively directs the gas flow from the discharge outlet to one or the other of a pair of conduits leading to the heat exchangers and simultaneously directs the flow from the other heat exchanger to the interior of the accumulator and therefrom to the suction inlet of the compressor. Shifting of the reversing valve will reverse the flow of refrigerant through the heat exchangers. A bypass valve located at the reversing valve is provided to divert flow from the compressor to the interior of the accumulator in response to a drop in temperature inside the accumulator when refrigerant is flowing to the first heat exchanger from the compressor, and the second heat exchanger, thereby providing a higher evaporating temperature in the second heat exchanger to effectuate the removal of accumulated frost therefrom. A combination oil aspirator/gas check valve leads from the accumulator to the suction inlet of the compressor to provide positive oil return to the compressor at all flow rates of returning suction gas.

20 Claims, 5 Drawing Figures

INTEGRATED CONTROLS ASSEMBLY

BACKGROUND OF THE INVENTION

1. Field of the Invention

This invention relates to an integrated controls assembly and, more specifically, to control assemblies for controlling the flow of refrigerant in heat pumps and air conditioners.

2. Description of the Prior Art

The use of heat pumps to alternately provide a heating or cooling effect to an enclosed space is well-known. Such systems exhibit several advantages over conventional refrigerating or air conditioning systems which provide a cooling effect only. Reference to the theory behind the operation of a refrigerating system or air conditioner is helpful to properly emphasize the special requirements of heat pumps.

In general, a typical air conditioning system includes an inside heat exchange coil (evaporator) connected to the suction inlet of a compressor. The discharge outlet of the compressor communicates with an outside heat exchange coil (condenser) which is, in turn, connected to the inside coil. An expansion device, such as a valve or turbine, is interposed in the line between the condenser and evaporator. A suitable refrigerant is circulated through the system by the compressor.

Relatively hot, high-pressure gaseous refrigerant flows from the compressor to the condenser, where the refrigerant gives up heat to the environment and is partially condensed. The relatively high-pressure liquid or partially condensed refrigerant then flows through the expansion device where the pressure and temperature of the refrigerant is reduced. As the refrigerant flows through the evaporator, it removes heat from the surroundings by evaporation of the condensed refrigerant. From the evaporator, the predominantly gaseous refrigerant flows to the compressor to complete the cycle.

In a heat pump system, the flow of refrigerant may be reversed when it is desired to switch the system from a cooling mode to a heating mode, or vice versa. In such a system, the functions of the inside and outside coils are reversed. Therefore, several additional components are required.

A reversing valve must be provided in the heat pump system to change the direction of flow of discharged refrigerant to the inside coil rather than to the outside coil when changing the heat pump's operation from the cooling mode to the heating mode. Reversing valves require four plumbing connections.

A suction line accumulator is typically interposed in the line leading from the evaporator to the suction inlet of the compressor, and requires two plumbing connections. The function of the accumulator is to trap liquid refrigerant which has failed to be evaporated and to prevent that liquid from entering the compressor. It is often desirable to provide a re-evaporator within the accumulator in order to allow the trapped liquid refrigerant to evaporate and return to the compressor suction inlet. An additional requirement of the accumulator is to allow the return of trapped lubricating oil and other unvaporizable liquids to the compressor at all system flow rates.

Heat pumps require a capability for defrosting the evaporator, especially when the heat pump is operating in its heating cycle. During the heating cycle, the outside coil acts as an evaporator, thereby removing heat from the area surrounding the coil. Thus, the evaporating temperature may fall below 32° F., thereby causing water vapor in the surrounding environment to condense and crystallize on the exterior surfaces of the evaporator's coil. Such crystallization is undesirable, as the resulting frost hinders efficient heat transfer. A known method of removing the frost is to direct hot gas from the compressor discharge to the outside coil for a period of time sufficiently long to melt the accumulated ice. This reversal of flow temporarily halts the release of heat by the inside coil, and therefore requires a supply of heat from another source, such as a resistance heater, for example.

A heater for the compressor crankcase is usually provided in heat pumps to maintain the crankcase oil at a temperature higher than the refrigerant in other parts of the system. This is desirable in order to reduce the migration of refrigerant to the crankcase. As a result, oil foaming at startup is reduced and oil loss and bearing wear problems are reduced.

For examples of typical heat pump operation and construction, attention is directed to U.S. Pat. Nos. 3,651,657 (Bottum), 3,412,574 (Reiter), 3,381,487 (Harnish) and 3,012,414 (LaPorte).

Previous systems including the above-described features presented problems related to cost and efficiency of operation. The cost of multiple safeguards, as described above, tends to be relatively high. This cost is compounded by resulting size requirements, as multiple components occupy a relatively great amount of space. Efficiency was hampered by relatively great external power requirements associated with the reversing valve and crankcase heater, and by the periodic interruption of operation for the purpose of defrosting the evaporator.

SUMMARY OF THE INVENTION

It is an object of the invention to provide an integrated controls assembly for use in a heat pump, wherein the controls assembly includes a suction line accumulator with a reversing valve contained therein to simplify the system.

A primary feature derived from location of the reversing valve in the accumulator is the capability of associating a hot gas bypass valve therewith which may be automatically operable to discharge hot gas into the accumulator to raise the pressure in the accumulator and therefore the evaporating temperature in the evaporator to avoid frosting without reversing the flow of the refrigerant. Additionally, a conduit within the accumulator leading to the reversing valve may be of a coiled length for additional heat transfer.

It is a further object of the invention to provide a controls assembly for a heat pump which includes controls to avoid the necessity of a crankcase heater in the compressor.

It is a still further object of the invention to provide a controls assembly for a heat pump having a suction line accumulator which contains a reversing valve, a bypass valve which operates by discharge of hot gas into the accumulator to prevent the evaporator from accumulating frost, and an oil return line, where the entire controls assembly requires only four plumbing connections and is relatively compact.

Still another object of the invention is to provide a controls assembly of the type described in the preceding paragraph wherein the oil return line extending into the accumulator includes an aspirating section responsive to flow of gas to the compressor to draw lubricating oil from the accumulator at a rate generally proportional to the gas flow rate.

DESCRIPTION OF THE PREFERRED EMBODIMENTS

Figure 1:
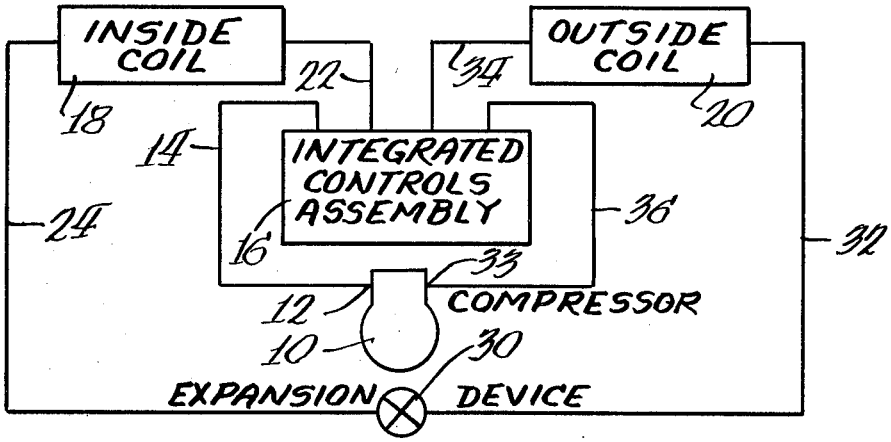
FIG. 1 is a schematic representation of a heat pump system embodying the features of the invention.

Referring to FIG. 1, the basic components of a heat pump are represented in schematic form. A compressor 10 circulates a suitable refrigerant through the system. The gaseous refrigerant, at a relatively high temperature and pressure, leaves a discharge outlet 12 of the compressor 10 and flows through a conduit 14 to an integrated controls assembly, generally designated as 16, which will be described in detail subsequently.

The heat pump operates in either a heating mode or a cooling mode depending upon the season of the year. Two heat exchangers, preferably and illustratively comprising a pair of coils 18 and 20, are disposed within the space to be cooled or heated (usually a room) and in the outside environment, respectively. In the heating mode, the inside coil 18 will function as a condenser, while the outside coil 20 acts as an evaporator. During the operation in the cooling mode, the functions of the respective coils are reversed.

When the heat pump is operating in the heating mode, high-pressure, high-temperature gaseous refrigerant flows from the integrated controls assembly through a conduit 22 to the inside of the coil 18 which, acting as a condenser, transfers heat from the refrigerant to the inside environment. Consequently, the refrigerant is cooled and is fully or at least partially condensed. The refrigerant then flows, by means of a conduit 24, to a suitable expansion device 30, which may comprise an orifice or other valve, or a turbine. The refrigerant is thus reduced in pressure and cooled before flowing, via a conduit 32, to the outside coil 20, which functions as an evaporator during the heating cycle.

As the mixture of relatively cool, low-pressure refrigerant flows through the coil 20, it picks up heat from the outside environment and is thereby substantially totally vaporized. The gaseous, relatively low-pressure refrigerant then flows, via a conduit 34, to the integrated controls assembly 16. The refrigerant which leaves the coil 20 may carry a small amount of unvaporized refrigerant into the integrated controls assembly 16 where, as will be described below, the unvaporized portion will be trapped and vaporized for return to the compressor 10.

The vaporized refrigerant then flows, via a conduit 36, to a suction inlet 38 of the compressor 10. The refrigerant is returned by the compressor 10 to a relatively high-temperature, high-pressure state for repetition of the cycle.

During the cooling cycle of the heat pump, the flow of refrigerant through the coils 18 and 20 is reversed, as are the respective functions of the coils. The refrigerant flows from the compressor discharge 12 through the conduit 14 to the integrated controls assembly 16 in the cooling cycle just as it does in the heating cycle. However, the high-pressure, high-temperature gas flows from the integrated controls assembly 16 through the conduit 34 to the outside coil 20, which acts as a condenser. The fully or partially condensed refrigerant flows via the line 32 to the expansion device 30 where it is reduced in pressure and cooled. The cool, low pressure mixture of gas and liquid then flows to the inside coil 18 via the conduit 24. The refrigerant picks up heat from the inside environment by evaporating while flowing through the coil 18, thus cooling the environment. The vaporized refrigerant (and any unevaporated liquid) then enters the integrated controls assembly 16 through the line 22 before the return of the vaporized portion of the refrigerant to the suction inlet 38 of the compressor 10 via the conduit 36.

The reversal of flow of refrigerant through the coils 18 and 20, the conduits 22, 24, 32 and 34 and the expansion device 30 is effected by a reversing mechanism incorporated in the integrated controls assembly 16.

The integrated controls assembly has several other functions which will be described generally. When the heat pump is operating in its heating mode and the outside coil 20 is functioning as an evaporator, heat is withdrawn from the immediate surroundings of the coil, causing the temperature of the outside surface of the coil 20 to drop. When that temperature drops below about 32° F., water vapor present in the air outside the coil 20 will condense and crystallize, forming unwanted frost. The integrated controls assembly 16 includes a bypass valve which will, under specific conditions, divert hot, high-pressure discharge gas from the conduit 14 to the interior of an accumulator in the form of a tank, also forming part of the integrated controls assembly. As will be described below, this will increase the pressure in the accumulator and consequently within the outside coil 20, thereby increasing the evaporation temperature within the coil 20 to remove (or prevent the formation of) frost. The bypass valve also functions to defrost the inside coil 18 during the cooling cycle, if needed.

An important feature of the integrated controls assembly is the suction line accumulator which traps unvaporized refrigerant flowing enroute from the evaporator to the suction inlet 38 of the compressor 10. This trapped liquid is vaporized by contact with the hot outer surface of a heat transfer section of the conduit 14 which carries hot gaseous refrigerant from the discharge outlet 12 of the compressor. This heat transfer section is preferably a finned coil and is contained within the accumulator tank.

Migration of liquid refrigerant to the discharge outlet 12 of the compressor 10 when the system is shut down is prevented by the provision of a conventional check valve in the conduit 14 at a point preferably located inside the accumulator of the integrated controls assembly 16. This obviates the need for a crankcase heater, the function of which is to minimize the adverse effects of liquid refrigerant which may be present in the compressor lubricant.

Also incorporated in the integrated controls assembly 16 is an oil pickup tube which, in combination with an oil aspirator/suction gas check valve, provides a positive rate of return of compressor lubricating oil and other non-vaporizable substances from the accumulator tank to the compressor 10, with the rate of return being generally proportional to the flow of gaseous refrigerant to the suction inlet 38.

Figure 2:
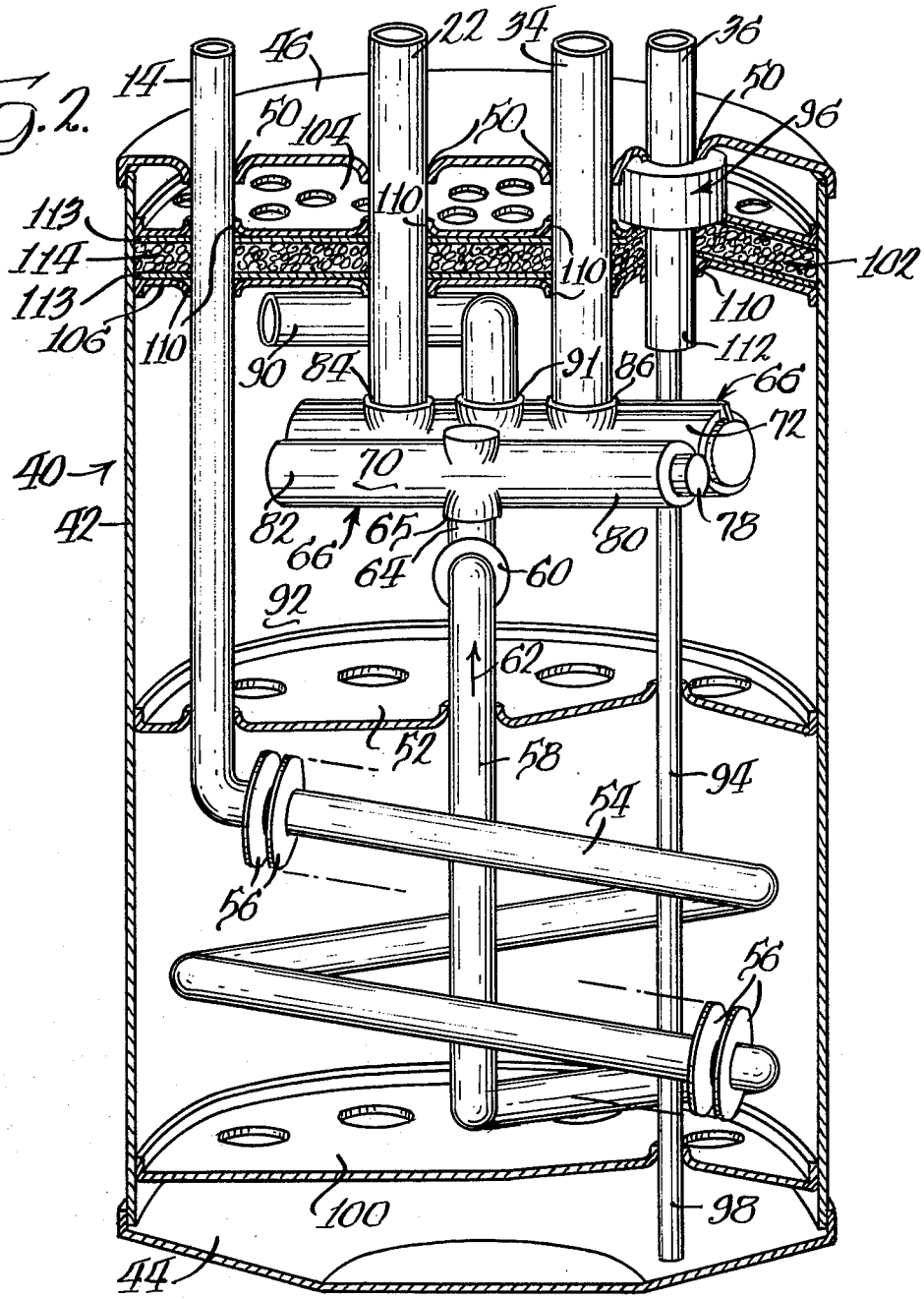
FIG. 2 is a perspective view of the integrated controls assembly represented in FIG. 1, taken through a section of the suction line accumulator, the controls assembly including a housing containing a reversing valve and a bypass valve, and further including a combination oil aspirator/suction gas check valve.

Now referring to FIG. 2, the integrated controls assembly 16 is illustrated in detail. An upstanding suction line accumulator 40, illustratively comprising a tank with a cylindrical shell 42, bottom 44 and cover 46, serves as a container for the other components of the integrated controls assembly 16. The cover 46 includes four ports 50 through which the conduits 14, 22, 34 and 36 extend.

The conduit 14, leading from the discharge outlet 12 of the compressor 10, enters the tank 40 through one of the ports 50 and extends downwardly through a perforate support disc 52. A coiled heat transfer section 54 of the conduit 14 is disposed in the lowermost section of the accumulator 40, and is preferably provided with a plurality of heat transfer fins 56, only a portion of which are shown. An upwardly extending section 58 of the conduit 14, leading from the bottom of the coil 54, is also supported by the disc 52.

A conventional check valve 60 is disposed in the conduit 58, and allows flow of gaseous refrigerant only in the direction indicated by the arrow 62. A short conduit 64 leads from the check valve 60 to a port 65 in a reversing valve assembly 66, the assembly 66 illustratively comprising two generally cylindrical closed end sleeves 70 and 72. The sleeves are interconnected by means of two short gas flow tubes 74 and 76 (shown in FIG. 3).

Referring again to FIG. 2, a bypass valve, generally indicated at 78, is contained in the sleeve 70 at one end 80 thereof. One part of a reversing valve assembly 66 is situated inside an end 82 of the sleeve 70 (FIG. 3), and the remaining part of the reversing valve assembly is contained within the sleeve 72. The specific nature of the operation of the reversing valve and of the bypass valve 78 will be discussed in detail below.

The conduit 22, leading to the inside coil 18, connects to the reversing valve sleeve 72 at a port 84 and extends upwardly through the cover 46. Similarly, the conduit 34, which leads to the outside coil 20, connects to the reversing valve sleeve 72 through a port 86 and extends through the cover 46. A short discharge conduit 90 leads from the sleeve 72 at a port 91 to the interior 92 of the accumulator 40.

An upstanding, relatively small diameter oil pickup tube 94 leads from the bottommost section of the accumulator 40 to a combination oil aspirator/suction gas check valve 96 located in the uppermost section of the accumulator 40. Details of the construction of the valve 96 will be discussed below. The conduit 36, leading to the suction inlet 38 of the compressor 10, extends from the valve 96 and through the cover 46.

The lower section 98 of the oil pickup tube 94 extends through and is secured by a perforate support disc 100. A filter-dryer 102 is horizontally disposed near the top of the accumulator 40 and also supports the tube 94. As illustrated, the filter-dryer 102 comprises two spaced perforate discs 104 and 106, each of which is provided with four openings 110 through which the conduits 14, 22 and 34 and a valve sleeve 112 of the valve 96 extend. Two filter pads 113 and a suitable desiccant material 114 are provided between the discs 106 and 110. The desiccant material 114 is packed tightly enough to provide a pressure drop effect in combination with the filter pads, yet the packing is not so tight as to totally prevent the flow of gas therethrough.

The operation of the several components of the integrated controls assembly 16 shown in FIG. 2 may best be described by reference to the flow of refrigerant in the heating and cooling cycles of a heat pump, as described generally above. In the heat pump's heating cycle, hot, high-pressure gaseous refrigerant flows into the accumulator 40 via the conduit 14. The coiled heat transfer section 54 may be at least partially in contact with condensed liquid refrigerant which has been trapped in the bottommost portion of the accumulator 40. The presence of the greatest portion of such liquid is due to incomplete vaporization of the refrigerant in the outside coil 20 when the heat pump is operating in its heating mode. The unvaporized liquid is trapped in the accumulator 40 after introduction to the interior 92 thereof via the conduit 90.

The fins 56 facilitate the transfer of heat from the heat transfer section 54 to the relatively cool, unvaporized refrigerant in the accumulator 40. The refrigerant is thereby vaporized and is removed from the accumulator 40 by means of the oil aspirator/check valve 96 and is returned, via the conduit 36, to the suction inlet 38 of the compressor 10. Unvaporizable components of the liquid refrigerant and lubricating oil are removed from the tank 40 via the oil pickup tube 94 and the oil aspirator/check valve 96. The aspirator/check valve 96 is constructed so as to provide a positive rate of return of liquid whenever gaseous refrigerant is flowing to the suction inlet 38 of the compressor 10. This is accomplished by an aspiration effect produced by the flow of gas through the check valve 96, as will be described in detail below.

After flowing through the coil 54, the hot discharge gas flows to the housing 66 via the conduit section 58, check valve 60, conduit 64 and the port 65. With the check valve, the lubricant present in the compressor does not become contaminated with refrigerant, and the need for a crankcase heater to prevent migration of unwanted refrigerant to the compressor is obviated.

The reversing valve, when the heat pump is operating in its heating mode, is disposed in a first position to place the port 65 in fluid communication with the port 84 and the conduit 22 which leads to the inside coil (condenser) 18. The port 86 and the conduit 34 are placed in fluid communication with the port 91 and the conduit 90 and hence with the interior 92 of the accumulator 40.

As a result, gaseous refrigerant leaving the compressor discharge outlet 12 flows to the inside coil 18 via the integrated controls assembly 16 and then flows through the expansion device 30 to the outside coil 20 when the reversing valve is disposed in its first position. From the outside coil 20, the refrigerant, now a mixture of gas and liquid, returns to the integrated controls assembly 16, whereby it is discharged to the interior 92 of the accumulator 40. The gas is removed through the suction gas check valve 96 and flows through the conduit 36 to the compressor suction inlet 38, thereby completing the heating cycle.

During the heating cycle, unwanted frost may accumulate on the exterior surfaces of the outside coil 20, which acts as an evaporator during the heating cycle. The integrated controls assembly 16 includes the bypass valve 78, located in one sleeve 70 of the reversing valve housing 66, which operates to raise the evaporating temperature within the outside coil 20 to a point sufficiently above the freezing point of water to prevent the accumulation of frost, or to remove already accumulated frost.

The bypass valve 78 is preferably of a type utilizing an expansible wax power element. The wax element may be activated by an electric resistance coil, but is preferably self actuating at a predetermined temperature.

The power element of the bypass valve 78 is disposed outside of the sleeve 70 to respond to the temperature in the accumulator which corresponds approximately to the temperature of the gas leaving the outside coil 20 and entering the accumulator 40 via the conduit 90. As frost accumulates on the coil 20, the temperature of the vaporized refrigerant leaving the coil 20 will, of course, tend to drop, thereby causing the temperature of the interior 92 of the accumulator 40 to drop. When the temperature in the accumulator drops to approximately the freezing point of water, 32° F., the power element will actuate the bypass valve 78, thereby allowing a small amount of hot, relatively high-pressure gaseous refrigerant to enter the accumulator. Overall efficiency of operation of the system is only nominally decreased since only a small amount of gas is bypassed.

The bypassed gas increases the pressure inside the accumulator 40, and consequently increases the pressure in the outside coil 20. As the pressure inside the outside coil 20 is increased, the evaporating temperature within the coil 20 is raised to a point sufficiently above the freezing point of water to melt the accumulated frost on the outside of the coil 20.

It will be apparent to those skilled in the art that the temperature responsive power element may be selected to actuate the bypass valve before the temperature of the interior 92 of the accumulator 40 reaches the point which indicates that frost has formed on the outside coil 20. By providing a bypass valve 78 which is actuated at a suitably high temperature, the accumulation of frost on the outside coil may be entirely avoided.

The temperature of the gas leaving the outside coil 20 and entering the accumulator 40 will tend to rise, as the refrigerant evaporates at an elevated temperature and pressure and the bypass valve 78 will be deactuated at a certain temperature.

When the reversing valve is shifted to its second position for the cooling mode, the port 65 and the conduit 64, through which gaseous refrigerant from the compressor discharge outlet flows, are placed in fluid communication, via the sleeves 70 and 72 and the conduit 74 (shown in FIG. 3), with the conduit 34 leading to the outside coil 20. The refrigerant flows from the outside coil 20 to the expansion device 30 via the conduit 32, then to the inside coil 18 via the conduit 24, and back to the integrated controls assembly 16 via the conduit 22. (See FIG. 1).

In the cooling mode, the accumulation of frost on the exterior surfaces of the evaporator (now the inside coil 18) is much less a problem than in the heating cycle.

Defrosting is accomplished by operation of the bypass valve 78 in a manner identical to that involved with the defrosting of the outside coil 20 in the heating cycle except, of course, that the pressure increase in the accumulator 40 is communicated to the inside coil 18 via the conduit 22.

Figure 3:
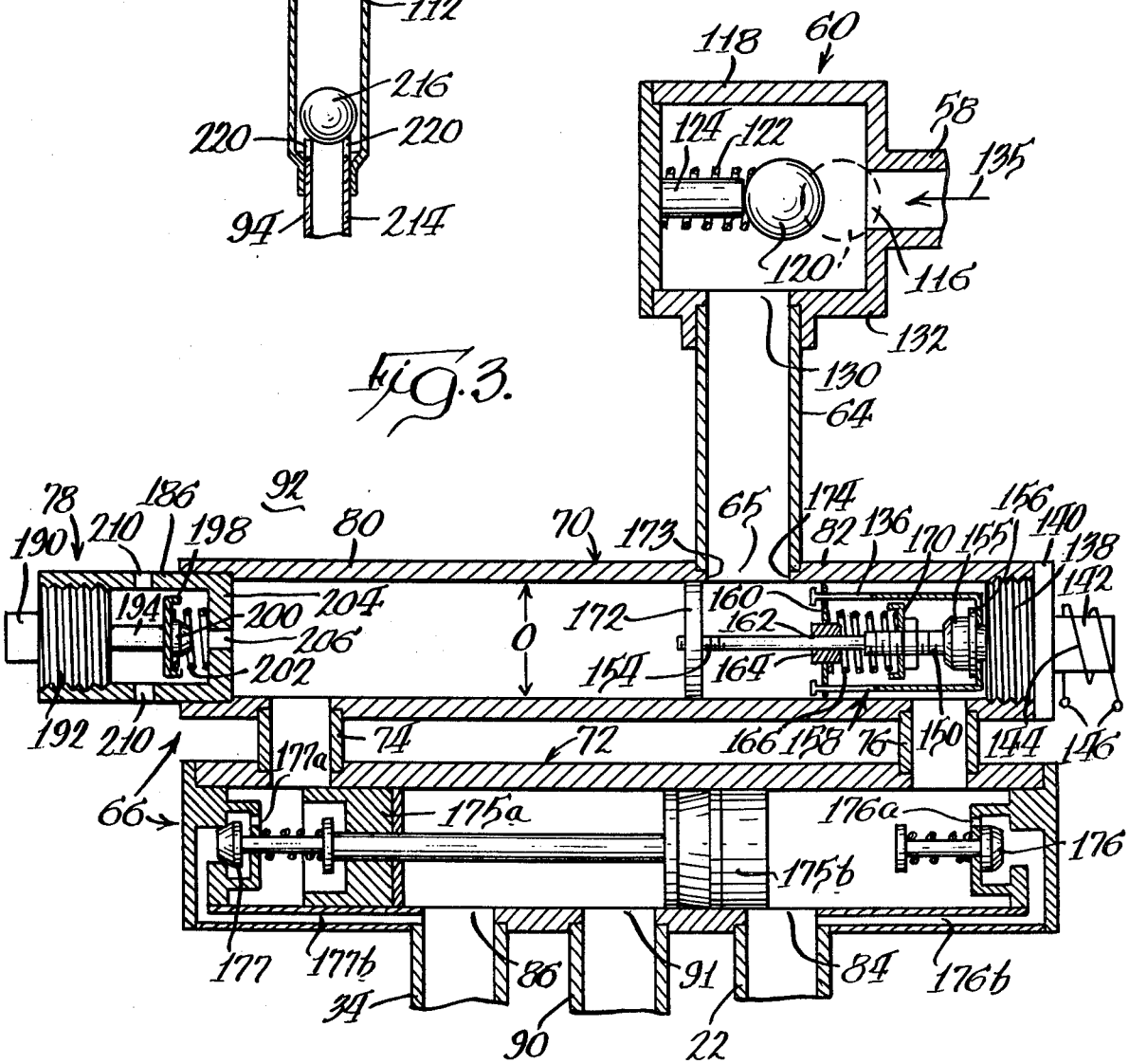
FIG. 3 is a sectional view of the housing of FIG. 2 containing the reversing valve and bypass valve.

Referring now to FIG. 3, the details of construction and operation of the preferred embodiments of certain components of the integrated controls assembly 16 will now be described. It will be understood by those skilled in the art that departures from the details of construction of these components may be made without departing from the broad concepts of the invention.

The check valve 60 has a valve seat 116 as a part of a hollow body 118. A spherical valve member 120 is urged toward the valve seat by a coiled spring 122 surrounding a stop pin 124. A port 130 in a side wall 132 of the body receives the conduit 64.

When the compressor 10 is not in operation (no gas flow), the spring 124 urges the valve member 120 to the broken line closed position and gaseous or liquid refrigerant can not flow from the reversing valve 66 to the compressor 10 by passing through the conduits 64 and 58.

When the compressor 10 is operating, gaseous refrigerant will flow into the check valve 60 in the direction indicated by the arrow 135 and the force provided by the flowing gas is sufficient to open the valve.

The reversing valve includes a flow diverter, indicated generally at 136. A threaded end 138 of the flow diverter 136 and a cap 140 effectively seal the end 82 of the sleeve 70. An expansible wax element 142 is situated in the cap 140, with an electrical resistance heating coil 144 disposed thereabout. The heating coil 144 is connected, as by the points 146, to an automatic or manually operated control device (not shown) which activates the wax element 142.

A threaded section 150 of a movable plunger extends axially from the flow diverter end 138 and has an extension 154. A flanged head 155 is formed integrally with the threaded end 138 of the diverter and captures a slotted end plate 156 against the threaded end. The end plate defines part of a generally cylindrical enclosure 158 which is generally concentric with and spaced from the sleeve 70. The plunger extension 154 extends through an opening 162 in a bushing 164 disposed in an end plate 160 of the enclosure 158.

A coil spring 166 between the end plate 160 and an adjustable abutment plate 170 on the plunger section 150 acts to retract the plunger.

A generally cylindrical diverter disc 172 is secured to an end of the plunger 154 and has a diameter which is slightly less than the inner diameter D of the sleeve 70 to permit gas flow across the disc for supplying refrigerant to the bypass valve 78.

When the wax element 142 is activated, the plunger 150 slides through the head 155, axially to place the diverter disc 172 in a first position, shown in FIG. 3, wherein the disc 172 is located to the left of an edge 173 of the port 65. When the wax element 142 is deactivated, the compressed spring 166 forces the plate 170 toward the right, thereby causing the disc 172 to move toward the right in FIG. 3 to a second position (not shown) wherein the disc 172 is located to the right of an edge 174 of the port 65.

Placement of the diverter disc 172 in its first position establishes the first position of the reversing valve, employed in the heating cycle of the heat pump, wherein gaseous refrigerant will flow from the conduit 64.

The diverter disc 172 functions primarily to direct flow to a valve spool 175 in the sleeve 72 and which controls the flow connections to the conduits 22, 34 and 90. The valve spool has a pair of lands 175*a* and 175*b* with the land 175*b* as shown in FIG. 3, directing flow from conduit 64 to conduit 22. When the valve spool 175 shifts to the right after diverter disc 172 shifts to the right then conduit 64 will be connected to conduit 34 and conduits 22 and 90 will be interconnected. A structure that could be used is shown in U.S. Pat. No. 3,293,880 and another preferred structure is shown in the application Ser. No. 736,878 of Gerald L. Davis and Timothy C. Scott filed Oct. 29, 1976.

The valve shown herein moves from left to right by gas pressure applied against valve land **175*a* and, after valve land 175*b* moves past port 84, a bleed valve 176 permits trapped gas to flow through a bleed port 176*a* and a bleed passage 176*b* to conduit 22. The bleed valve will move to a closed position when the stem thereof is contacted by the valve land 175*b*. In moving from right to left gas pressure acts on valve land 175*b* and, after valve land 175*a* moves past conduit 34, trapped gas can flow through bleed port 177*a* and and bleed passage 177*b* to conduit 34 until bleed valve 177** closes.

The bypass valve 78 illustratively includes a cup-shaped hollow body 186, in one end of which is located a power element in the form of a thermally responsive wax expansion element 190. A threaded plug 192 seals the leftward end of the bypass valve 78 and supports an axially extending wax element operated plunger 194 carrying a radially extending plate 198 and a valve member 200. A coil spring 202 abuts the plate 198 and a base 204 of the body 186 to urge the valve member away from a port 206 in the base 204. A plurality of ports 210 about the circumference of the body 186 outside the sleeve 80 permits gas flow to the interior 92 of the accumulator 40.

The expansible wax element 190 is exposed to the temperature of the gas in the accumulator which is normally substantially above 32° F. The wax element 190 is chosen so as to contract, thereby permitting the spring 202 to open the valve, when the temperature of the gas in the accumulator falls below approximately 32° F. When the temperature in the tank is greater than about 32° F., the wax element 190 is activated and the plunger 194 is extended, thereby closing the port 206 and preventing the flow of gas therethrough.

To switch the heat pump's operation from its heating cycle to its cooling cycle, the diverter disc 172 is placed in the second position to the right of the edge 174 of the port 65 in FIG. 3. The flow of gas from the conduit 64 is to the tube 74.

The valve spool 175 shifts to place the ports 84 and 91 in fluid communication, while the port 86 is placed in fluid communication with the tube 74.

The bypass valve 78 operates during the cooling cycle in a manner similar to that in the heating cycle to bleed gas, when necessary, to the interior 92 of the accumulator 40.

Figure 4:
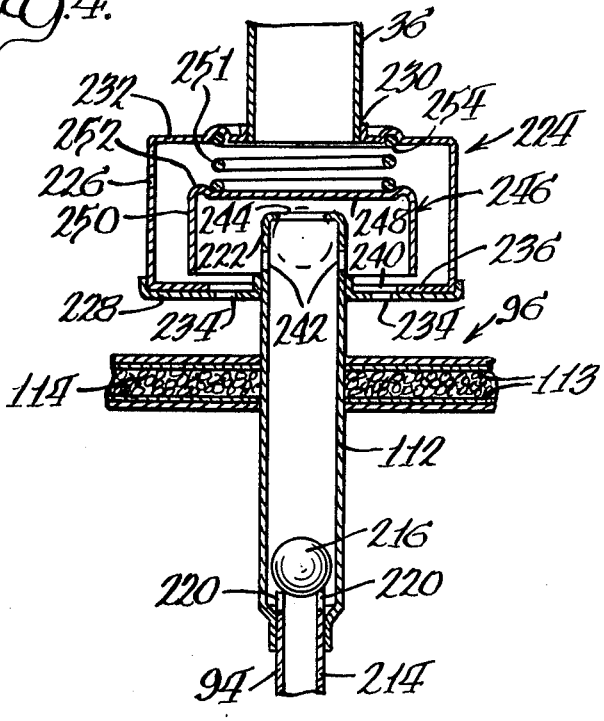
FIG. 4 is a vertical sectional view of the combination oil aspirator/suction gas check valve of FIG. 2.
Figure 5:
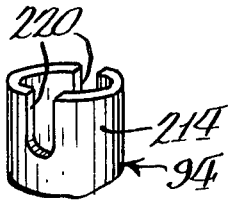
FIG. 5 is a perspective view of the upper end of the oil return tube shown in FIGS. 2 and 4.

Referring to FIG. 4, the oil aspirator/gas check valve has a relatively narrow upstanding oil pickup tube 94 terminating at its upper end 214 within the generally elongate cylindrical valve sleeve 112. Positioned for vertical movement within the valve sleeve 112 is a spherical valve member 216 which may rest on the top of the tube 94. Two axially extending notches 220 are provided at the upper extremity of the oil pickup tube 94 and are best seen in FIG. 5, whereby there can be oil flow even when the valve member 216 is resting on the top of the tube 94.

The upper end section 222 of the valve sleeve 112 terminates within a generally cylindrical check valve housing 224 comprising a cup-shaped cover 226 and a flat bottom plate 228. The conduit 36 extends upwardly from a port 230 in the upper side 232 of the cover 226. A plurality of gas inlet ports 234 are disposed radially of the valve sleeve 112 in the bottom 228.

An annular plate 236 is positioned on the bottom plate 228 and within the cover 226, with a central open section 240 of the base 236 overlying the inlet ports 234. A plurality of ports 242 are disposed radially in the valve sleeve 112 at a level above the base plate 236. A port 244 is disposed horizontally at the top of the end section 222.

A cup-shaped valve member 246 of a diameter less than that of the cover 226 is inverted with its substantially flat base 248 extending substantially perpendicularly to the axis of the sleeve 112 and overlying the port 244. A cylindrical wall 250 depends from the base 248 toward the base plate 236 and abuts thereagainst when the valve is closed. A coil spring 251 acting between a boss 252 on the base 248 and a groove 254 underneath the side 232 urges the valve member 246 downwardly.

Suction created by the compressor 10 results in a region of relatively low pressure within the conduit 36. The force created by the pressure differential between the pressure conditions in the conduit 36 and the area beneath the valve member 246 which is exposed to gas in the accumulator urges the valve member 246 upwardly slightly, to create an opening between the bottom of the depending wall 250 and the base plate 236, thereby allowing gaseous refrigerant to flow through the ports 234 and 240, underneath the depending wall 250 and into the conduit 36 for delivery to the compressor.

As the gas flows from the port 240 through the space adjacent the lower edge of the wall 250, it accelerates due to the decrease in available cross-sectional area. A region of relatively low pressure is thereby created underneath the valve member 246 so as to produce an aspiration effect in the oil pickup tube 94 and the valve sleeve 112.

The aspiration effect (or partial vacuum) draws oil up the tube 94 and causes the valve member 216 to rise within the valve sleeve 112. Since the pressure within the accumulator 40 is greater than that within the aspirator/check valve 96, liquid present in the bottom of the tank 40 at a level higher than the open bottom end 98 of the tube 94 will be forced into the tube 94 through the end 98 and drawn upward. Such liquid comprises compressor lubricating oil and certain unvaporizable components of the refrigerant, both of which are trapped within the accumulator 40 after introduction thereto through the conduit 90.

It will be noted that the valve member 216 is of a diameter less than the inner diameter of the sleeve 112, and will therefore allow liquid to flow around it. The valve member 216 will rise to different levels within the sleeve 112, depending on the pressure differential between the tube 94 and the housing 224, with the valve member 216 rising higher within the sleeve 112 as the pressure differential increases. When the valve member 216 reaches its ultimate elevated position, shown by dotted line, the ports 242 are unobstructed.

It will be noted that the resistance to gas flow inherent in the filter-dryer 102 of FIG. 2 aids the flow of liquid by enhancing the pressure drop from below the filter-dryer 102 to the area above the filter-dryer 102, where the gas inlet ports 234 and 240 are located. It will be appreciated that the primary effect of the filter-dryer 102 is to dry and clean the suction gas before the introduction thereof into the compressor 10.

It will be apparent to those skilled in the art that higher gas flow rates through the housing 224 will produce correspondingly higher flow rates of liquid through the pickup tube 94 and, ultimately, to the compressor suction inlet 38.

We claim:

1. An integrated controls assembly for use in a heat pump or the like including first and second heat exchangers, said heat exchangers being in fluid communication through an expansion device, and a compressor in fluid communication with each of said heat exchangers to circulate refrigerant through said heat exchangers and said expansion device, the integrated controls assembly comprising:

(a) an accumulator communicating with each of said heat exchangers and with the discharge outlet and suction inlet of said compressor;

(b) a first conduit leading from the discharge outlet of said compressor with a section of said conduit being within said accumulator;

(c) second and third conduits placing said accumulator in communication with said first and said second heat exchangers, respectively;

(d) a reversing valve assembly within said accumulator and placing said first conduit in selective communication with either said second conduit or said third conduit and placing the conduit not communicating with the first conduit in communication with the interior of said accumulator;

(e) a bypass valve associated with said first conduit to place said first conduit in fluid communication with the interior of said accumulator in response to heat;

(f) an oil conduit communicating with the lowermost section of said tank; and (g) a combination aspirator/check valve having a gas inlet within said accumulator and connected to said oil conduit and a fourth conduit leading to the suction inlet of the compressor for the simultaneous return of oil and gaseous refrigerant from the interior of said accumulator to the said suction inlet by the gas flow creating a partial vacuum to draw oil through the oil conduit for return with the gas to said suction inlet of the compressor.

2. An assembly as defined in claim 1 wherein said first conduit section is coiled within the tank to provide a heat transfer section for vaporization of liquid refrigerant in the accumulator by the heat of hot gas from the compressor.

3. An assembly as defined in claim 1 wherein said bypass valve is operable by a power element responsive to the temperature in the accumulator.

4. An assembly as defined in claim 3 wherein said power element is a heat responsive wax element.

5. An assembly as defined in claim 1 wherein said check valve is cup-shaped with a cylindrical wall enclosing a plurality of ports from said oil conduit and said accumulator to block flow therethrough when closed and opening movement of said check valve permits gas flow through at least one of the ports and under said cylindrical wall to create a suction for oil aspiration.

6. An integrated controls assembly for use in a heating and cooling system including first and second heat exchangers in fluid communication, and a compressor in fluid communication with each of said heat exchangers, comprising:

(a) an accumulator communicating with each of said heat exchangers and with the discharge outlet and suction inlet of said compressor;

(b) a first conduit leading from the discharge side of said compressor with a section of said conduit being within said accumulator;

(c) second and third conduits placing said accumulator in communication with said first and said second heat exchangers, respectively; and (d) a reversing valve assembly within said accumulator and placing said first conduit in selective communication with either said second conduit or said third conduit and placing the conduit not communicating with the first conduit in communication with the interior of said accumulator.

7. An integrated controls assembly for use in a system including first and second heat exchangers and a compressor in fluid communication with each of said heat exchangers to circulate refrigerant through said heat exchangers comprising:

(a) an accumulator tank communicating with each of said heat exchangers and with the discharge outlet and suction inlet of said compressor;

(b) a first conduit leading from the discharge side of said compressor with a section of said conduit being within said accumulator tank;

(c) second and third conduits placing said accumulator tank in communication with said first and said second heat exchangers, respectively;

(d) a reversing valve assembly contained within said accumulator tank and placing said first conduit in selective communication with either said second conduit or said third conduit and placing the conduit not communicating with the first conduit in communication with the interior of said accumulator; and (e) a bypass valve at the reversing valve to place said first conduit in fluid communication with the interior of said accumulator in response to temperature conditions within said tank, said bypass valve having a power element operable in response to the temperature within the accumulator to open said bypass valve at a predetermined low temperature and cause the entry of gas into the accumulator to increase the gas pressure in the accumulator.

8. An integrated controls assembly for a heating and cooling system having a compressor, a suction gas accumulator with conduits extending therefrom for connection to system components with one of said conduits connected to the compressor, said one conduit having a coiled heat transfer section inside said accumulator and connected to a reversing valve positioned within said accumulator and having connections to certain of said conduits for reversing flow through said conduits to change between heating and cooling, with said coiled heat transfer section exposed to liquid refrigerant in the accumulator for vaporization of said liquid refrigerant.

9. An integrated controls assembly for use in a heating and cooling system including first and second heat exchangers in fluid communication, and a compressor in fluid communication with each of said heat exchangers, comprising:

(a) an accumulator communicating with each of said heat exchangers and with the discharge outlet and suction inlet of said compressor;

(b) a first conduit leading from the discharge side of said compressor with a section of said conduit being within said accumulator;

(c) second and third conduits placing said accumulator in communication with said first and said second heat exchangers, respectively;

(d) a reversing valve assembly within said accumulator and placing said first conduit in selective communication with either said second conduit or said third conduit and placing the conduit not communicating with the first conduit in communication with the interior of said accumulator; and (e) means for placing said first conduit in fluid communication with the interior of said accumulator in response to temperature conditions within said accumulator, whereby said means is actuated at a predetermined low temperature to cause the entry of gas into the accumulator to increase the gas pressure in the accumulator.

10. An assembly as defined in claim 9 wherein said coiled conduit has heat dissipating fins thereon and a check valve preventing flow through said coiled conduit in a direction away from said reversing valve.

11. An integrated controls assembly for a heating and cooling system having a suction gas accumulator with conduits extending therefrom for connection to system components, and a reversing valve positioned within said accumulator and having connections to certain of said conduits for reversing flow through said conduits to change between heating and cooling where in said reversing valve has a first chamber and an inlet thereto, an outlet from said chamber to the interior of the accumulator, normally closed valve means blocking said outlet, and means for opening said valve means in response to the existence of a predetermined temperature in said accumulator.

12. An assembly as defined in claim 11 wherein said valve opening means includes a temperature responsive power element.

13. An integrated controls assembly for a heating and cooling system having a suction gas accumulator with conduits extending therefrom for connection to system components, a compressor with one of said conduits connected thereto, a reversing valve positioned within said accumulator and having connections to certain of said conduits for reversing flow through said conduits to change between heating and cooling, an oil pickup tube connected to said one conduit and opening to the lower end of the accumulator for flow of lubricating fluid to said one conduit, and a suction gas inlet within the accumulator communicating with said one conduit for delivery of gas to said one conduit and related to said tube to have the gas flow function as an oil aspirator and draw oil into the gas flow to the compressor.

14. An assembly as defined in claim 13 including a combined oil aspirator and check valve unit associated with said one conduit and having a cup-shaped check valve which closes to prevent flow toward the accumulator and which opens in response to a gas pressure differential.

15. An assembly as defined in claim 14 wherein said cup-shaped check valve has a cylindrical well enclosing a plurality of ports from said oil pickup tube and said accumulator to block flow therethrough when closed and opening movement of said check valve permits gas flow through at least one of the ports and under said cylindrical wall to create a suction for oil aspiration.

16. An assembly as defined in claim 15 with a filter assembly in said accumulator through which gas must pass in flowing to said conduit and which creates a pressure differential to assist in drawing oil through said oil pickup tube.

17. An assembly as defined in claim 13 wherein said oil pickup tube has an upper end positioned within a valve sleeve and is of a smaller diameter than said valve sleeve and a valve member movable in said valve sleeve and engageable against said upper end to retard the flow of oil.

18. An assembly as defined in claim 17 wherein said movable member is a ball which rests on the upper end of said tube and which may move upwardly along said valve sleeve as oil is initially drawn up said tube to create a drag on oil flow up the tube.

19. An integrated controls assembly for a heat pump system having a suction gas accumulator, a gas outlet conduit connected to said accumulator and leading to a system component and having an entry end with a valve casing with ports opening to said accumulator, a check valve in said valve casing urged to a position to close said ports and openable in response to flow demand from said component and the gas pressure in the accumulator with the amount of opening movement of the check valve being responsive to the rate of gas flow, an oil intake tube extended to a location adjacent the bottom of the accumulator and effectively terminating in said valve casing whereby gas flow through the check valve creates a suction to draw oil from said tube which flows with the gas to the system component.

20. An assembly as defined in claim 19 wherein said valve has a cylindrical depending wall enclosing said ports and a port from said oil intake tube to block flow therethrough when closed and opening movement of said check valve permits gas flow through said ports and under said cylindrical wall to create an aspirating suction to draw oil through the oil intake tube port.

* * * * *

UNITED STATES PATENT AND TRADEMARK OFFICE

CERTIFICATE OF CORRECTION

PATENT NO. : 4,100,762

DATED : July 18, 1978

INVENTOR(S) : GERALD L. DAVIS and TIMOTHY C. SCOTT

It is certified that error appears in the above-identified patent and that said Letters Patent are hereby corrected as shown below:

Column 13, line 17, change "9" to --8--.

Signed and Sealed this

*Fifth* Day of *June 1979*

[SEAL]

*Attest:*

RUTH C. MASON
*Attesting Officer*

DONALD W. BANNER
*Commissioner of Patents and Trademarks*